US009055850B2

(12) United States Patent
Jerg et al.

(10) Patent No.: US 9,055,850 B2
(45) Date of Patent: Jun. 16, 2015

(54) DISHWASHER WITH AN OPTIMIZED FILLING SEQUENCE

(75) Inventors: Helmut Jerg, Giengen (DE); Anton Oblinger, Gersthofen (DE); Michael Georg Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 355 days.

(21) Appl. No.: 13/503,031

(22) PCT Filed: Oct. 27, 2010

(86) PCT No.: PCT/EP2010/066231

§ 371 (c)(1),
(2), (4) Date: Apr. 20, 2012

(87) PCT Pub. No.: WO2011/054711

PCT Pub. Date: May 12, 2011

(65) Prior Publication Data

US 2012/0204907 A1 Aug. 16, 2012

(30) Foreign Application Priority Data

Nov. 3, 2009 (DE) ..... 10 2009 046 359

(51) Int. Cl.
*A47L 15/00* (2006.01)
*A47L 15/42* (2006.01)

(52) U.S. Cl.
CPC ..... *A47L 15/0023* (2013.01); *A47L 15/4217* (2013.01); *A47L 15/4225* (2013.01); *A47L 2401/08* (2013.01); *A47L 2501/01* (2013.01)

(58) Field of Classification Search
CPC ..... A47L 15/0023; A47L 15/4244; A47L 2401/08
USPC ..... 134/56 D, 57 D, 58 D
See application file for complete search history.

(56) References Cited

U.S. PATENT DOCUMENTS

2004/0099287 A1* 5/2004 Shin ..... 134/18
2005/0005952 A1* 1/2005 Bashark ..... 134/18

FOREIGN PATENT DOCUMENTS

DE 19630357 A1 2/1998

(Continued)

OTHER PUBLICATIONS

International Search Report PCT/EP2010/066231.

*Primary Examiner* — David Cormier
(74) *Attorney, Agent, or Firm* — James E. Howard; Andre Pallapies

(57) ABSTRACT

A dishwasher includes a control device controlling a dishwashing cycle for cleaning items to be washed, a dishwashing chamber for the items to be washed, an inlet valve for controlled filling the washing chamber with washing liquid, and a circulating pump for circulating the washing liquid in the dishwashing chamber. The inlet valve is opened during a primary filling phase having a duration sufficient to fill the dishwashing chamber with a nominal amount of washing liquid and allowing the circulating pump running to run concentrically at a rated speed. A concentricity monitoring unit performs a concentricity check at the end of the primary filling phase to ascertain whether the circulating pump is running concentrically at the rated speed. The filling sequence is terminated when the circulating pump is running concentrically, whereas the filling sequence is continued when the circulating pump is not running concentrically.

12 Claims, 4 Drawing Sheets

(56) References Cited

FOREIGN PATENT DOCUMENTS

| | | | |
|---|---|---|---|
| EP | 1029498 | A2 | 8/2000 |
| EP | 1967121 | A1 | 9/2008 |
| FR | 2499396 | A1 | 8/1982 |
| FR | 2589057 | A1 | 4/1987 |

* cited by examiner

DISHWASHER WITH AN OPTIMIZED FILLING SEQUENCE

BACKGROUND OF THE INVENTION

The present invention relates to a dishwasher, in particular a domestic dishwasher, with a control device for carrying out a washing cycle for cleaning items to be washed, with a washing chamber for accommodating the items to be washed during the washing cycle, with an inlet valve switchable by the control device for filling the washing chamber with washing liquid and with a circulating pump able to be set by the control device, in particular able to be controlled or regulated for circulating the washing liquid located in the dishwashing chamber. Commercially available dishwashers are embodied to automatically fill their washing chamber with washing liquid. Despite sometimes complex filling methods, the exact dispensing of the desired amount of washing liquid is not always successful. In addition with some filling methods undesired noise can be generated during the filling of the washing chamber with washing liquid.

BRIEF SUMMARY OF THE INVENTION

The object of the present invention is to provide a dishwasher, in particular a domestic dishwasher, in which the filling of the dishwashing chamber with washing liquid is improved.

The object is achieved for a dishwashing machine of the type stated above by the washing cycle comprising at least one filling sequence in which the inlet valve is opened during a primary filling phase, the duration of which depends on a default time which corresponds to a nominal quantity of washing liquid which is to be introduced into the dishwashing chamber, which is sufficient for concentricity of the circulating pump running at a rated speed, and for which a concentricity check is undertaken by means of the concentricity monitoring unit connected to the control device for data exchange at the end of the primary filling phase to ascertain whether the circulating pump running at the rated speed is running concentrically, wherein if the circulating pump is running concentrically, the filling sequence is terminated and if the circulating pump is not running concentrically the filling sequence is continued.

The inventive dishwasher has a control device for automatic control of operating sequences of the dishwasher. The control device can be embodied for this purpose as a sequence controller, especially as an electronic sequence controller.

Stored in the control device is at least one dishwashing program for carrying out or controlling a washing process, also referred to as a washing cycle, especially for washing dishes. Advantageously a number of dishwashing programs are provided in such cases, of which one is selected and can be started by the operator in each case. This makes it possible to adapt the sequence of a dishwashing cycle, especially to the load amount, to the load type, to the degree of soiling of the items to be washed and/or to the desired duration of the washing cycle.

The stored dishwashing programs can preferably be embodied so that the washing cycle controlled by them in each case comprises especially at least one prewash cycle for preliminary cleaning of items to be washed, at least one cleaning cycle for thorough cleaning of items to be washed, at least one intermediate wash cycle for removal of soiled washing liquid from the items to be washed, at least one rinsing cycle for avoiding spots on the items to be washed and/or for preparing for a drying step and/or at least one drying cycle for drying the items to be washed. Preliminary wash cycle, cleaning cycle, intermediate wash cycle and rinsing cycle are referred to as water-conducting part wash cycles since, while they are being carried out, the items to be washed introduced into the dishwashing chamber are treated with a washing liquid. During the drying cycle there is generally no provision for using washing liquid.

The items to be washed are treated with washing liquid in such cases in an essentially closed dishwashing chamber, especially a dishwashing container of the dishwasher. In such cases the dishwashing chamber is assigned an inlet valve which makes it possible to fill the dishwashing chamber with washing liquid. Also assigned to the dishwashing chamber is a circulating pump for circulating the filled washing liquid, which makes it possible to take the washing liquid present in the dishwashing chamber from a collection device for dishwashing liquid for example and apply it to the items to be washed via a spray system assigned to the dishwashing chamber. The inlet valve and also the circulating pump are able to be controlled in such cases via the control device of the dishwasher.

A washing liquid here is especially to be understood as a liquid which is intended to be applied to the items to be washed in order to clean said items and/or treat them in some other way. Thus the washing liquid can for example be designed for heating up the items to be washed, which is normal during a rinsing step for example.

The washing liquid flowing into the dishwashing chamber via the inlet valve is generally fresh water. In such cases the washing liquid in the dishwashing chamber, depending on the operating phase of the dishwasher, can contain cleaning agents, cleaning aids, such as rinsing aids for example and/or soiling which has been released from the items to be washed. However cases are also conceivable in which the dishwashing chamber is filled via the inlet valve with water to which agents have already been added.

The inventive dishwasher is embodied so that, during the execution of a dishwashing cycle, at least one filling sequence for filling the dishwashing chamber with washing liquid is carried out, which comprises a primary filling phase and a concentricity check. The primary filling phase is a time interval during which the inlet valve is open so that, during the primary filling phase, washing liquid flows into the dishwashing chamber. The duration of the primary filling phase in such cases depends on a default time which is stored for example in the control device of the dishwasher. The amount of washing liquid introduced during the primary filling phase thus depends on the default time.

The default time is selected in such cases so that, with a fault-free filling process, the dishwashing chamber is filled with an amount of dishwashing liquid that corresponds to the nominal amount of dishwashing liquid to be introduced into the dishwashing chamber. The nominal amount is determined in such cases so that the circulating pump, at its rated speed or at a desired nominal speed, can be operated concentrically. In such cases a speed of the circulating pump can be selected as the rated speed of the circulating pump at which the circulating pump reaches its maximum intended pump power.

In such cases a circulating pump is then generally running concentrically if there is sufficient washing liquid in the collection device of the washing chamber to prevent air being sucked in by the circulating pump. Whether air is now sucked in or not in individual cases depends here on factors such as the speed of the circulating pump. The reason for this lies in the fact that, as the speed of the circulating pump increases, an ever smaller part of the total washing liquid present in the dishwashing chamber is located in the collection device, since it takes a certain time for the washing liquid sprayed onto the items to be washed to return to the collection device.

The fact that the nominal quantity is designed for concentric running of the circulating pump at a rated speed enables it to be ensured that, with a problem-free filling cycle, it is possible to operate the pump at its rated speed at the end of the primary filling phase. In this case the optimum actual amount of washing liquid is present in the dishwashing chamber at the end of the primary filling phase.

A concentricity check is now undertaken at the end of the primary filling phase, which serves to establish whether the circulating pump running at a nominal speed is actually running concentrically. A concentricity monitoring unit is used for this. This can especially be a component of the control device or can be connected to the control device of the dishwasher for exchange of data. Provided the concentricity check now reveals that the circulating pump running at its rated speed or desired nominal speed is running concentrically, the filling sequence is ended, since in this case an optimum quantity of washing liquid is located in the dishwashing chamber. If on the other hand the concentricity check reveals that the circulating pump running at its rated speed is not yet running concentrically, it can be deduced that a fault has occurred during the primary filling phase which has led to the actual amount of washing liquid remaining below the nominal amount. In this case the filling sequence is continued in order to introduce the amount of washing liquid still missing.

An important advantage of the inventive dishwasher lies in its simplicity. Thus in particular a simple switchable inlet valve can be used, which can merely assume an open position and a closed position, since it is not necessary to vary the inflow of washing liquid while the dishwashing chamber is being filled. This also enables the control device to be embodied in a simple manner since it is merely intended to output two control commands to the inlet valve, namely "valve open" and "valve closed". A complex control of the speed of the circulating pump is also not necessary. Instead it can be operated continuously at a specific rated speed or nominal speed, which simplifies both the construction of the circulating pump and also the construction of the control device of the dishwasher. With a fault-free filling process it is also ensured that at the end of the primary filling phase there is a sufficient quantity of washing liquid in the dishwashing chamber. In this case the filling sequence is concluded significantly more quickly than with those filling methods which basically provide a multi-stage filling. The case distinction based on concentricity checking still ensures that the filling sequence is not aborted too early in the event of a fault occurring.

In accordance with an expedient development of the invention the continuation of the filling sequence comprises a secondary filling phase during which the inlet valve is open when the circulating pump is running at its rated speed, wherein the secondary filling phase is ended when the circulating pump reaches concentric running. Conversely the control device blocks the inlet valve after the end of the primary filling phase if the concentricity monitoring unit has established that the circulating pump is running concentrically. This ensures in a simple manner that the quantity of washing liquid required for the concentric running of the circulating pump at its rated speed is introduced in the shortest possible time into the dishwashing chamber. In this case neither a control of the speed of the circulating pump nor control of the speed of the inflow of washing liquid into the dishwashing chamber is necessary.

In accordance with an advantageous development of the invention, the primary filling phase is followed by the secondary filling phase carried out if necessary. A further time benefit is produced in this way.

In accordance with an advantageous development of the invention, the inlet valve is opened from the beginning of the primary filling phase up to the end of the secondary filling phase carried out if necessary. In this way the time required for the filling sequence can be further reduced.

In accordance with an expedient development of the invention the circulating pump can be switched off if necessary during the primary filling phase, before the concentricity check is undertaken. In this way undesired noise produced by the sucking-in of air by the circulating pump when the amount of washing liquid is still small can be avoided.

In accordance with an expedient development of the invention the filling sequence is provided at the beginning of at least one water-conducting part wash cycle. In this way it is ensured that a sufficient quantity of washing liquid is let into the dishwashing chamber in the shortest possible time at the beginning of the part wash cycle.

In accordance with an expedient development of the invention an input side of the inlet valve is provided for connection to an external water supply device. In this way it is possible to accept inlet water during the filling sequence as washing liquid, so that the washing liquid to be introduced into the dishwashing chamber does not have to be kept in the dishwasher.

In accordance with an especially advantageous development of the invention the circulating pump comprises an electric motor, wherein the concentricity monitoring unit is embodied to monitor at least one electrical operating parameter of the electric motor. This is based on the knowledge that electrical operating parameters of the electric motor change characteristically depending on whether the circulating pump is running concentrically or not. This applies for example to a circulating pump running at a fixed voltage for its current or power consumption. Thus at a given speed the power consumption of a circulating pump sucking in air is far below the power consumption of a circulating pump exclusively sucking in washing liquid. Such a concentricity monitoring unit is of a simple construction in such cases. This applies especially by comparison with concentricity monitoring devices which monitor the operating noise of the circulating pump.

In accordance with an expedient development of the invention the concentricity monitoring unit is embodied for monitoring fluctuations of the electrical operating parameter of the electric motor. If there is too little washing liquid in the dishwashing chamber the circulating pump, as already mentioned, does not only suck in washing liquid, but also air. The ratio of sucked-in air and sucked-in washing liquid fluctuates in this case around a statistical mean value. These fluctuations in their turn lead to fluctuations of the electrical operating parameter of the circulating pump, so that the evaluation of the fluctuations, without recording the absolute value of the operating parameter, allow information to be provided about whether the circulating pump is running concentrically or not. This enables the quality of the concentricity checking to be improved.

The invention also relates to a method for carrying out a washing cycle for cleaning items to be washed with washing liquid in a dishwashing chamber of a dishwasher by means of its control device, wherein the dishwasher includes an inlet valve able to be switched by the control device for introducing washing liquid into the washing chamber and a circulating pump for circulating the washing liquid located in the washing chamber. In this case at least one filling sequence is carried out, in which the inlet valve is opened during a primary filling phase, the duration of which depends on a default time which corresponds to a nominal amount of washing liquid to be introduced into the dishwashing chamber for the concentric running of the circulating pump and for which, at the end of the primary filling phase, it is established with a concentricity check whether the circulating pump running at the rated speed is running concentrically, wherein, if the circulating pump is running concentrically, the filling sequence is terminated and if the circulating pump is not running concentrically the filling sequence is continued.

The inventive method makes a simple, rapid and safe filling of the dishwashing chamber with washing liquid possible and is characterized by low demands on the mechanical design of the dishwasher.

Other advantageous embodiments and/or developments of the invention are the subject of the subclaims.

The advantageous embodiments and/or developments of the invention given here, as well as the advantageous developments of the invention reproduced in the dependent claims, can be provided individually or in any given combination with one another in the inventive dishwasher.

The invention and its developments as well as their advantages will be explained below in greater detail with reference to drawings.

DETAILED DESCRIPTION OF EXEMPLARY EMBODIMENTS OF THE PRESENT INVENTION

Figure 1:
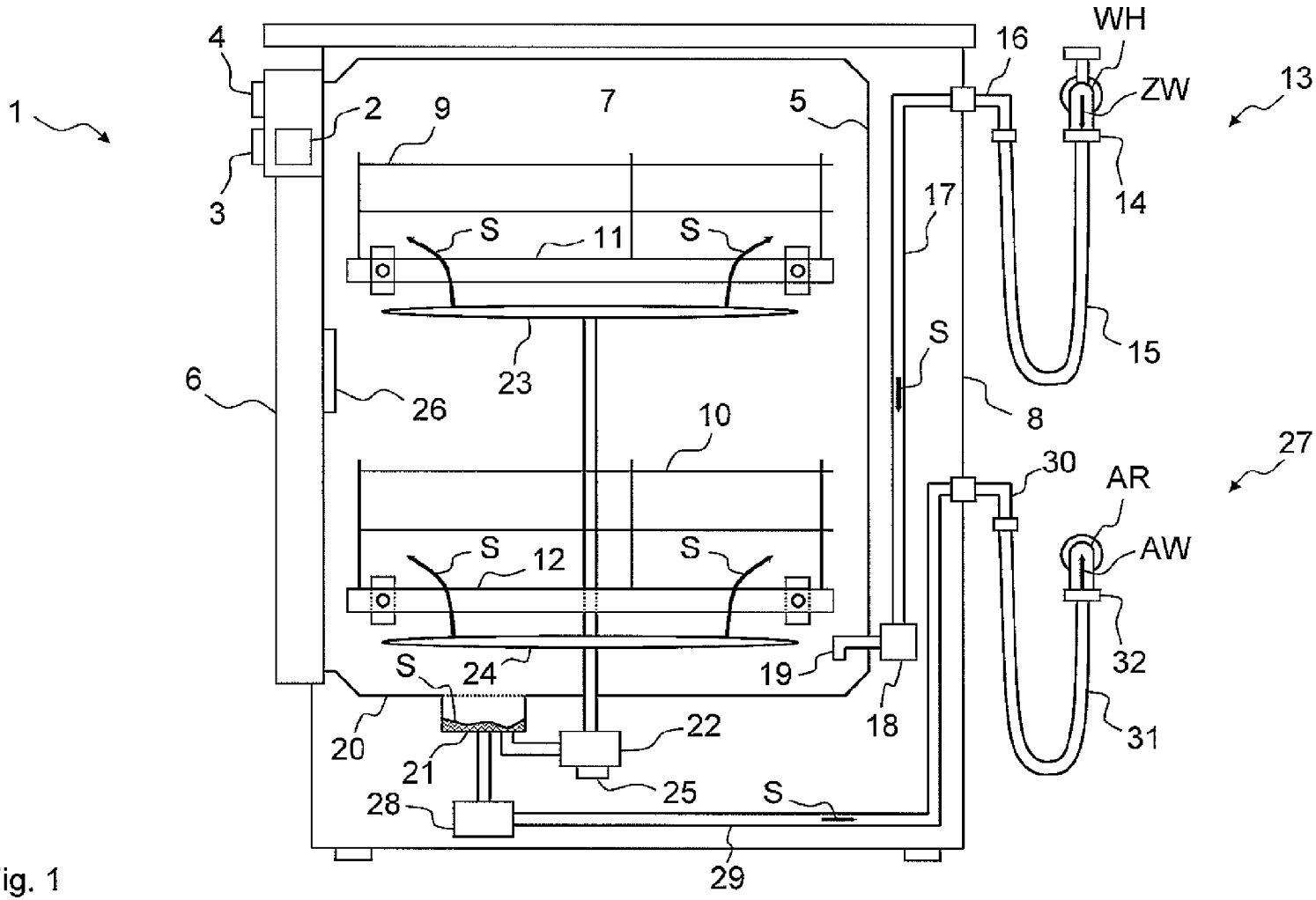
FIG. 1 an advantageous exemplary embodiment of an inventive domestic dishwasher in a schematic side view, FIG. 2 a block diagram of the domestic dishwasher of FIG. 1, FIG. 3 a flow diagram of a filling sequence for the domestic dishwasher of FIGS. 1, 2, and FIG. 4 an example of a wash cycle for the dishwasher of FIGS. 1 and 2.

In the figures below parts that correspond to one another are provided with corresponding reference characters. In such cases only those components of a dishwasher which are required for understanding the invention are provided with reference characters and explained. It goes without saying that the inventive dishwasher can include further parts and components.

FIG. 1 shows an advantageous exemplary embodiment of an inventive domestic dishwasher 1 in a schematic side view. The dishwasher 1 has a control device 2, in which at least one dishwashing program is stored for controlling a washing cycle for washing items to be washed, especially dishes. Expediently in such cases a number of dishwashing programs are stored so that, by selecting a suitable dishwashing program, the sequence of a washing cycle controlled by the control device 2 can for example be adapted to the load amount, to the load type, to the degree of soiling of the items to be washed and/or to the desired duration of the washing cycle.

The control device 2 is assigned an operating device 3, which allows an operator of the dishwasher 1 to call up one of the dishwashing programs and start it through said device. Furthermore the control device 2 is assigned an output device 4 which makes it possible to output messages to the operator. For output of optical messages, the output device 4 can comprise indicator lamps, light emitting diodes, an alphanumeric display and/or a graphic display. The output device 4 can also feature a buzzer, a loudspeaker or the like for output of acoustic messages.

The dishwasher 1 also includes a washing container 5 which is able to be closed off by a door 6 so that a closed dishwashing chamber 7 for washing items to be washed is produced. The washing chamber 5 can in this case be disposed if necessary inside the housing 8 of the dishwasher. With built-in dishwasher is the housing 8 is not necessary and can be omitted entirely in some cases at the top. In FIG. 1 the door 6 is shown in its closed position. The door 6 is able to be moved into its open position by pivoting it around an axis arranged in a plane at right angles to the plane of the drawing which is aligned essentially horizontally and makes it possible to insert or to remove items to be washed. In the exemplary embodiment shown in FIG. 1 the operating device 3 is disposed in a user-friendly manner on an upper section of the door 6. The output device 4 is likewise disposed on an upper section of the door 6, so that the optical messages are easily able to be seen and acoustic messages easily able to be heard. The control device 2 is also positioned there, so that the required signal connections between the operating device 3, the output device 4 and/or the control device 2 can be kept short. In principle however it is possible to assign the operating device 3, the output device 4 and/or the control device 2 a different position. In particular the control device, in accordance with an alternative embodiment, can also be accommodated in a base module below the washing container. The control device 2 could also be embodied decentrally, meaning that it comprises spatially-distributed components which are connected via communication means such that they can interact.

For positioning dishes the dishwasher 1 has an upper crockery basket 9 and a lower crockery basket 10. The upper crockery basket 9 is arranged here on pull out rails 11 which are each attached to opposite side walls of the washing container 5 extending in the depth direction of the dishwasher. When the door 6 is opened, the crockery basket 9 is able to be withdrawn by means of the pull out rails 11 from the washing container 5 which makes it easier to load or unload the upper crockery basket 9. The lower crockery basket 10 is arranged on pull out rails 12 in a similar manner.

The washing program or washing programs stored in the control device 2 can each provide a number of part wash cycles, for example in this sequence at least one prewash cycle, at least one cleaning cycle, at least one intermediate wash cycle, at least one final rinse cycle and at least one drying cycle. In this case prewash cycle, cleaning cycle, intermediate wash cycle and rinsing cycle are referred to as water-conducting part wash cycles, since when they are being executed the items to be washed positioned in the dishwashing chamber 7 are treated with a washing liquid S. During the drying cycle there is generally no provision for treating the items to be washed with washing liquid S.

Fresh water or inlet water ZW, which are taken from an external water supply device WH, especially a drinking water mains supply and can be introduced into the dishwashing chamber 7, are used in the exemplary embodiment as washing liquid S for treating the items to be washed. Typically in such cases, at the beginning of each water-conducting part wash cycle, a washing liquid S formed from fresh inlet water ZW is introduced, which is then discharged at the end of the respective part wash cycle to an external waste water disposal device AR as waste water AW. However it is also possible to store a washing liquid S of a part wash cycle in a storage container not shown in the diagram and introduce it in a later part wash cycle back into the dishwashing chamber 7.

The dishwasher 1 in FIG. 1 in this case comprises a water inlet device 13 which is provided for connection with the external water supply device WH. As in FIG. 1, the external water supply device can involve a water tap of a building-side water installation which provides inlet water ZW under pressure. The water inlet device 13 comprises a connection piece 14 which is intended to be connected to the water faucet WH. The connection can be made for example via a threaded arrangement, a bayonet arrangement or the like. A connection hose 15 is provided downstream from the connecting piece 14, which is preferably embodied as a flexible hose. The downstream end of the connecting hose 15 is connected to a connection piece 16 fixed to the housing.

Downstream from the fixed connecting piece 16 a supply line 17 is provided which is connected to an input side of an inlet valve 18 able to be switched by means of the control device 2. In its turn and output side of the inlet valve 18 is connected to a fluid inlet 19 of the dishwashing chamber 7. In this way it is possible, by means of the water inlet device 13 to convey inlet water ZW as washing liquid S into the inside of the dishwashing chamber 7 of the dishwasher 1. The inlet valve 18 in this case can be embodied as a switchable magnetic valve having only an open position and a closed position. In the supply line 17 a water preparation system not shown in the diagram, for example a water-softening system, can be provided.

Instead of or in addition to the device-side inlet valve 18, and external inlet valve, especially what is referred to as an Aqua stop valve, can also be provided between the connection piece 14 and the water faucet WH, which is preferably able to be switched, especially blocked or opened, by means of the control device.

The amount of washing liquid S introduced into the dishwashing chamber 7 per unit of time, i.e. the inflow, is produced in such cases especially primarily by the construction of the inlet valve 18 as well as from the pressure of the washing liquid S on the input side of the inlet valve 18. Provided the input-side pressure of the washing liquid S lies within a tolerance range provided of for example +−10% and also if no faults occur, a constant rated inflow is produced when the inlet valve 18 is open. With this type of fault-free filling process the quantity of washing liquid S introduced is the result of the product of the rated inflow and the duration of the rated inflow. If the inlet valve 18 is thus opened for a defined period then the quantity of washing liquid S introduced into the dishwashing chamber 7 can be derived therefrom. If however faults occur during the operation of the dishwasher 1, the inflow actually achieved can lie far below the rated inflow. Such faults are for example a fault in the pressure of the washing liquid S on the input side of the inlet valve 18, contamination in the area of the inlet valve 18 or upstream from said valve as well as a possible kinking of the flexible connection hose 15.

The washing liquid S arriving in the dishwashing chamber 7 via the fluid inlet 19, because of its gravitational force, reaches a collection device 21 embodied on a base 20 of the dishwashing container 5, which can preferably be embodied as a collection dish 21. An input side of a circulating pump 22 in this case is connected for conduction of fluid to the collection dish 21. An output side of the circulating pump 22 is also connected to a spray device 23, 24, which makes it possible to apply the washing liquid S items to be washed introduced into the dishwashing chamber 7. In the exemplary embodiment of FIG. 1 the spray device 23, 24 comprises an upper rotating spray arm 23 and a lower rotating spray arm 24. However alternative or additional fixed spray elements could also be provided.

The washing liquid S emerging from the spray device 23, 24 when the circulating pump 22 is switched on, because of its gravitational force, arrives within the dishwashing chamber 7 back in the collection dish 21. During the circulation of the washing liquid S in the dishwashing chamber 7 the aim is for the circulating pump 22 to be operated concentrically. The circulating pump 22 is operating concentrically if a large enough amount of washing liquid S is available here for it to convey exclusively washing liquid S, or expressed conversely, for it not to convey any air. The concentric operation of the circulating pump 22 on the one hand enables a sufficient pump pressure to be achieved for an intended cleaning effect and on the other hand enables the formation of disruptive slurping noises to be avoided. In order to now determine whether the circulating pump 22 is running concentrically or not, it is assigned a concentricity unit 25. This can be provided as a separate component or if necessary also be a component of the control device 2.

Furthermore, in a conventional manner, the dishwasher 1 includes a dispensing device 26 which makes it possible to add cleaning agents and/or cleaning aids to washing liquid S introduced into the dishwashing chamber 7 in order to improve the cleaning effect and/or the drying effect of a washing cycle.

The dishwasher 1 shown in FIG. 1 also has a drainage device 27 which serves to pump washing liquid S no longer needed out of the dishwashing chamber 7 as waste water AW. The drainage device 27 comprises a drain pump 28, of which the input side is connected to the collection dish 21. The output side of the drain pump 28 on the other hand is connected to a connecting line 29 of which the downstream end is connected to a fixed connection 30 of the dishwasher 1. Attached to an output of the fixed connection 30 is a drain hose 31 which is embodied as a flexible hose. Arranged at the downstream end of the drain hose 31 is a connection piece 32 which is intended to connect the drainage device 27 with a waste water disposal device AR. The waste water disposal device AR can be a drainage pipe of a building-side water installation. The connection between the connection piece 32 and the drainage pipe can be embodied as a screw connection, as a bayonet connection, as a plug-in connection or the like.

Figure 2:
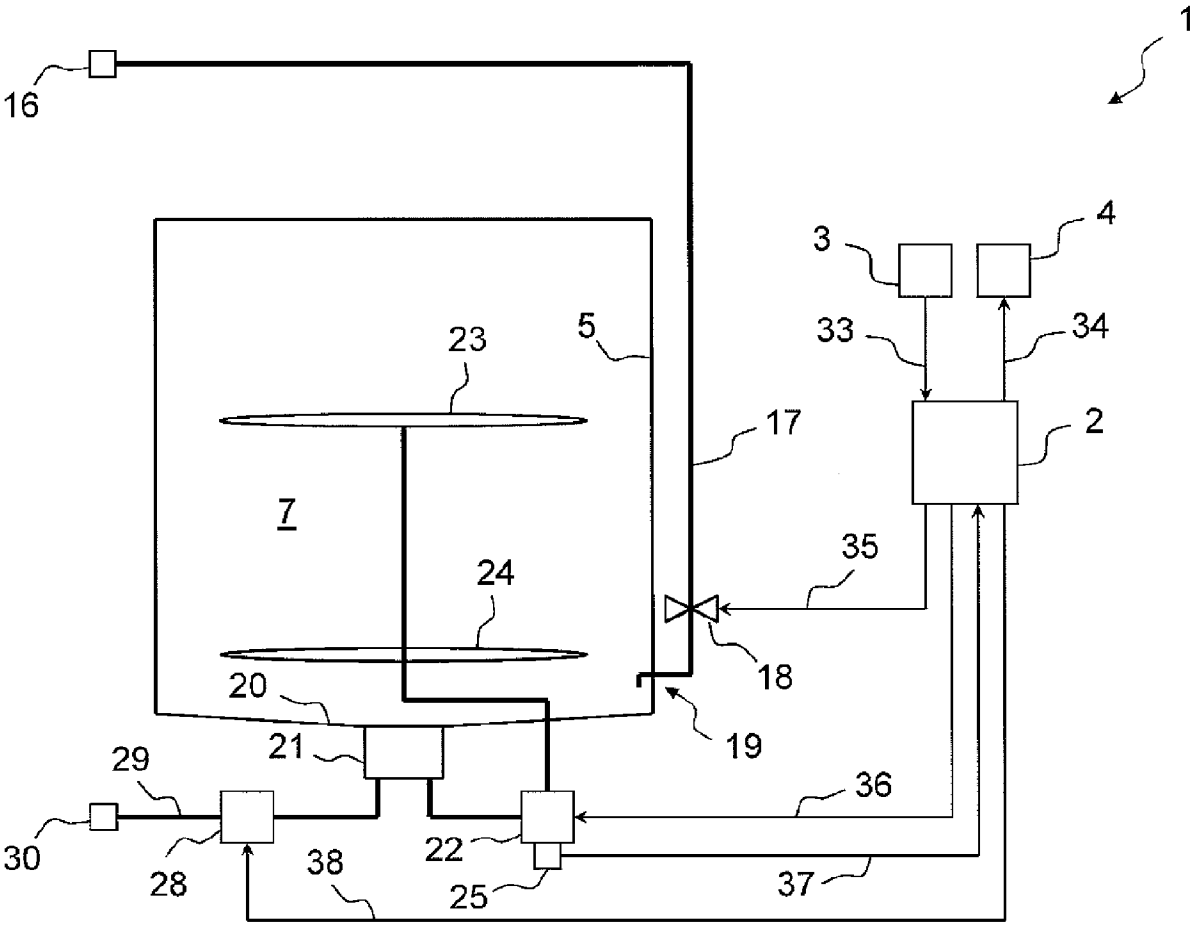

FIG. 2 shows a block diagram of the domestic dishwasher 1 of FIG. 1, wherein the diagram shows the control and communication concept in particular. In the exemplary embodiment a signal line 33 is provided, which connects the operating device 3 to the control device 2 such that operating commands from an operator are able to be transmitted from the operating device 3 to the control device 2. A signal line 34 is also provided which connects the control device 2 to the output device 4 such that information provided by the control device 2 can be transmitted to the output device 4 and can be output there to the operator.

A control line 35 is also provided, which connects the control device 2 to the switchable inlet valve 18 such that the inlet valve 18 can be closed or opened respectively by the control device 2. In this way the control device 2 can control the filling of the dishwasher chamber 7 with washing liquid S. A further control line 36 connects the control device 2 to the circulating pump 22. This allows the control device 2 to also set the circulation of washing liquid S in the dishwashing chamber 7, especially to control or regulate it.

A signal line 37 is also provided which connects the concentricity monitoring unit 25 to the control device 2. The signal line 37 makes it possible to transmit information relating to the running characteristics of the circulating pump 22 generated by the concentricity monitoring unit 25 to the control device 2. In this case the control device 2 is embodied so that during the switching, especially during the control of the closing and/or opening times, if necessary also control or regulation of the inlet valve 18, this information can be taken into account by the concentricity monitoring unit 25. Furthermore a control line 38 is provided which connects the control device 2 to the drain pump 28, so that the drain pump 28 is also able to be switched by the control device 2, especially switched off and on.

Figure 3:
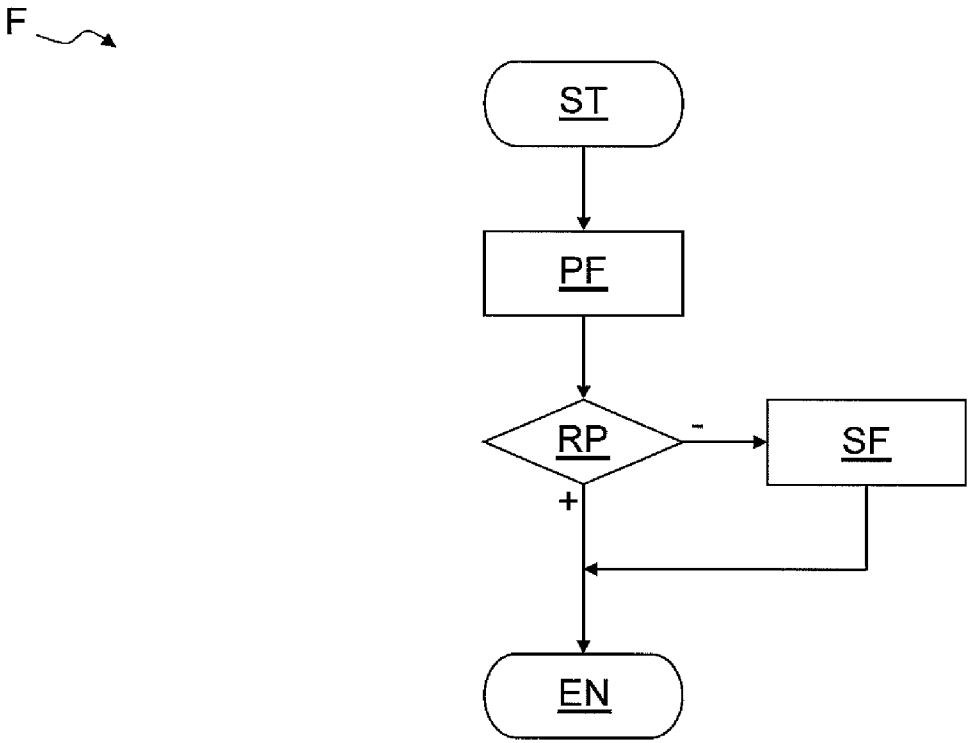

FIG. 3 shows a flow diagram of a filling sequence S for the inventive domestic dishwasher one of the exemplary embodiment. The filling sequence F represents a self-contained aspect of the invention. It can be conducted or controlled by the control device 2 and can be carried out one or more times during the execution of a washing cycle. After the start ST of the filling sequence F, a primary filling phase PF is carried out, during which the inlet valve 18 is open. The duration of the primary filling phase PF depends in this case on a default time which can be contained for example in a washing program called up by the operator. The default time is defined in this case so that, in fault-free operation of the dishwasher 1, a nominal amount of washing liquid S reaches the dishwasher chamber 7 which is sufficient for concentric running of the circulating pump 22 running at a rated speed. Appended to the end of the primary filling phase TF is a concentricity check RP in which the concentricity monitoring unit 25 checks whether the circulating pump running at its rated speed or nominal speed is running concentrically or not. In this case a case branch can be provided. Provided the circulating pump 22 is running concentrically as intended, the end EN of the filling sequence F is reached directly. This case always occurs when the filling sequence F is not influenced by fault variables, which cause the actual inflow to be lower than the rated inflow or nominal inflow of fresh water.

If on the other hand the result of the concentricity checking RP is that the circulating pump 22 running at its nominal speed is not running concentrically, which is generally caused by the occurrence of fault variables, the filling sequence F is continued. In such cases a secondary filling phase SF is advantageously carried out, during which the inlet valve 18 is opened with the circulating pump 22 running at its rated speed or nominal speed, wherein the running characteristics of the circulating pump 22 are monitored during the secondary filling phase SF when the circulating pump 22 achieves concentricity.

The filling sequence F explained with reference to FIG. 3 ensures that, at its end EN the circulating pump 22 can be operated concentrically at its rated speed. In this case neither a complex variable control of the speed of the circulating pump 22 nor a control of the inflow of washing liquid S introduced is necessary. By comparison with a conventional dishwasher, in which the amount of washing liquid S introduced is controlled exclusively as a function of time, in respect of the mechanical design of the inventive dishwasher 1, only the concentricity monitoring unit 25 as well as an adaptation of the control device 2 is required. The filling sequence F also allows washing liquid S to be used sparingly. Thus the default time can be a minimum value which, under the most favorable conditions, just makes it possible for the circulating pump 22 to run concentrically at its rated speed. The provision of reserves in this case is namely not required, since an actual amount of washing liquid S which is too small as a result of faults at the end of the primary filling phase PF can be compensated for in the further progress of the filling sequence.

During the primary filling phase PF it is not necessary to operate the circulating pump 22. This enables disruptive slurping noises as a result of an insufficient amount of washing liquid S to be avoided for a circulation during the primary filling phase PF. In the far more frequent cases in which the concentricity monitoring RP establishes a concentric running of the circulating pump 22, disruptive slurping noises can be completely avoided in this way. If at the end of the primary filling phase PF concentric running has not yet been ascertained, slurping noises may still occur during the concentricity check RP or respectively during the secondary filling phase SF, which as a rule however only occurs for a short period so that these noises can be tolerated.

If necessary it can also be expedient for the circulating pump to already be switched on at the beginning of the water inflow during the primary filling phase.

Figure 4:
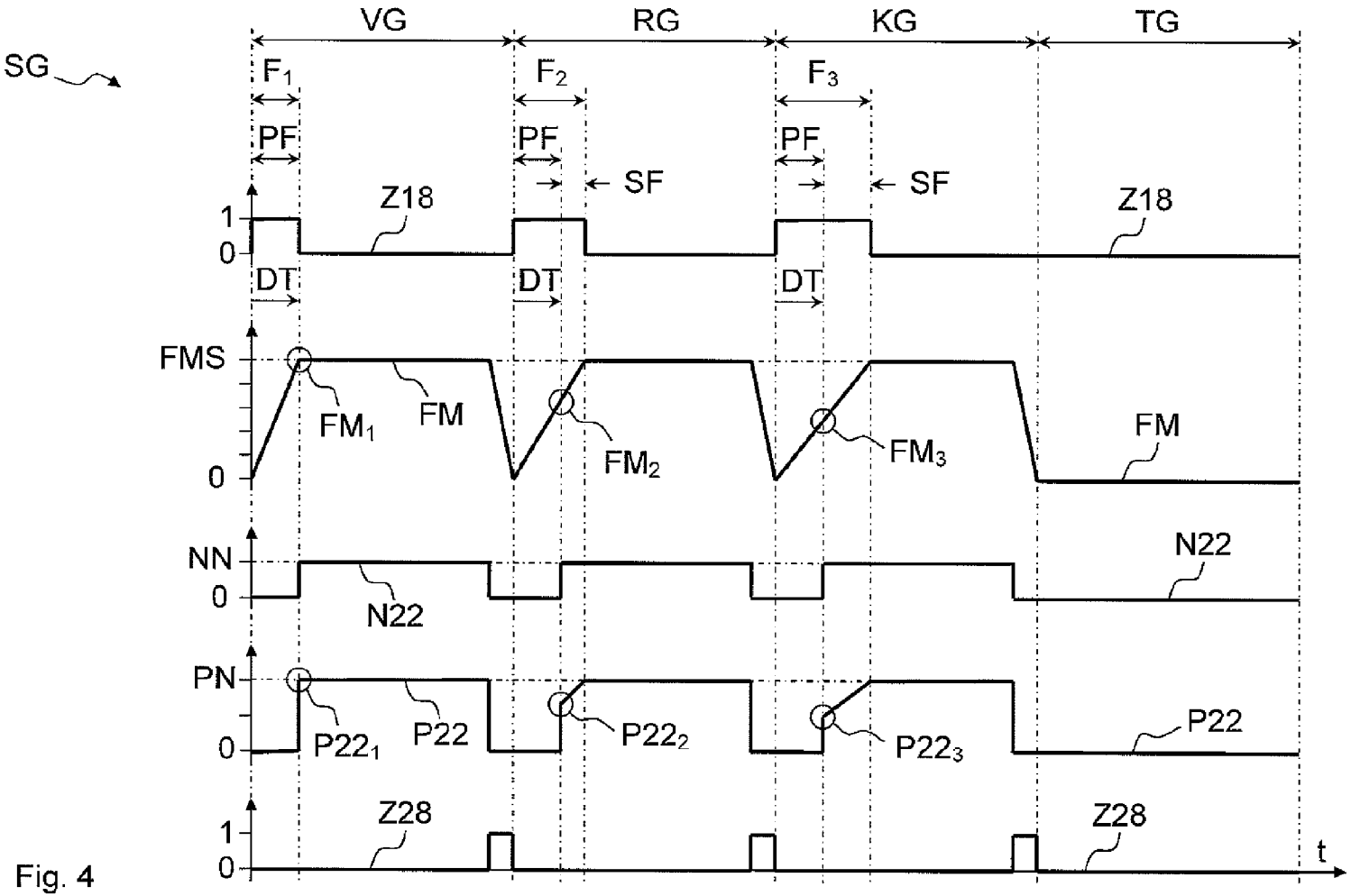

FIG. 4 shows a typical timing sequence of a washing cycle SG of the inventive dishwasher 1 of the exemplary embodiment. The washing cycle SG comprises three water-conducting part washing cycles, namely a pre-wash cycle VG, a cleaning cycle RG and a final rinse cycle KG. The washing cycle SG also includes a drying cycle TG. In this case a curve Z18, a curve FM, a curve N22, a curve P22 and a curve Z28 are shown on a common time axis t.

In the diagram the curve Z18 shows the operating state of the inlet valve 18. The inlet valve 18 in this case can assume an operating state of "0" in which it is closed, and can assume an operating state of "1" in which it is opened. The curve FM shows the actual amount of washing liquid S in the dishwasher chamber 7.

Furthermore the curve N22 shows the speed of the circulating pump 22. The electrical power consumption of the circulating pump 22 is shown in this case by the curve P22.

Finally the curve Z28 symbolizes the operating state of the drain pump 28. In this case the operating state "0" means that the drain pump 28 is switched off and the operating state "1", that the drain pump 28 is switched on.

Basically there is provision in the washing cycle SG for washing liquid S to be introduced into the dishwashing chamber 7 at the beginning of the water-conducting part wash cycles VG, RG and KG and for it to be pumped out of the dishwashing chamber 7 again at the end of the respective part wash cycle VG, RG and KG. A first filling sequence $F_1$ is thus provided at the beginning of the prewash cycle VG, in which a primary filling phase PF is carried out, the duration of which depends on a default time DT stored in the control device 2. In the example of FIG. 4 it is assumed that the primary filling phase PF executes without any faults, so that at the end of the primary filling phase PF the actual amount $FM_1$ of washing liquid S to be found in the dishwashing chamber 7 corresponds to an intended desired amount FMS. This is selected so that the power $P22_1$ consumed by the circulating pump reaches a value which corresponds to its rated power consumption PN if the circulating pump 22 is now switched on at the end of the primary filling phase PF and is operated at a nominal speed NN. The concentricity check RP, which is also based on a comparison of the actual consumed power $P22_1$ and the rated power consumption PN of the circulating pump 22, leads in the present case to the result that the circulating pump, 22 is running concentrically. Therefore the filling sequence $F_1$ is aborted after the end of the primary filling phase PF and the inlet valve 18 is closed. The circulating pump 22 is now operated for a time predefined by the control device 2 at a nominal speed NN with rated power consumption PN in order to pre-clean the items to be washed. Shortly before the end of the prewash cycle VG the circulating pump 22 is switched off and the washing liquid S of the prewash cycle VG is pumped out of the dishwashing chamber 7 by the drain pump 28 being switched on temporarily. When the washing liquid S of the prewash cycle VG is pumped away, the drain pump 28 is switched off again and a transition is made to the cleaning cycle RG.

As an alternative it is naturally also possible to switch on the circulating pump writer the beginning of the primary filling phase of the respective water-conducting part wash cycle and to bring it up to its rated speed or nominal speed by the end of the primary filling phase, with which the circulating pump runs concentrically for the nominal amount of water introduced into the dishwashing chamber without sucking in air.

At the beginning of the cleaning cycle RG, here in the exemplary embodiment, there is provision for a filling sequence $F_2$, wherein initially the primary filling phase PF is carried out, the duration of which is defined by the default time DT. To illustrate the functioning of the inventive dishwasher 1 it is now assumed that during the primary filling phase PF, because of a fault, there is an inflow of fresh water which is smaller than the rated inflow. In this case the actual amount $FM_2$ of washing liquid S located in the washing chamber 7 is smaller than the rated amount FMS. If the circulating pump 22 is now switched on again and operated at a rated speed NN, a power consumption $P22_2$ is produced which is less than the rated power consumption PN. Thus the result of comparing the actual power consumption $P22_2$ with the rated power consumption PN is that the circulating pump 22 is not yet running concentrically but is conveying at least partly air. For this reason the control device 2 causes a secondary filling phase SF to be carried out.

During the secondary filling phase SF the inlet valve 18 remains open and the circulating pump 22 continues to be switched on. In this case a concentricity check is carried out until the concentrate running of the circulating pump 22 is achieved. At this point in time the inlet valve 18 is closed so that the secondary filling phase SF and the filling sequence $F_2$ overall is ended. The further execution of the cleaning cycle RG corresponds to the execution of the prewash cycle VG explained above.

In the final rinse KG now carried out a further filling sequence $F_3$ is undertaken, wherein here in the exemplary embodiment it is assumed that the inflow of washing liquid S is further reduced because of faults. This makes the actual amount $FM_3$ of washing liquid S in the dishwashing chamber 7 at the end of the primary filling phase PF even smaller than the actual amount $FM_2$ at the end of the primary filling phase PF of the cleaning cycle RG. This reason a secondary filling phase SF is likewise carried out, which lasts longer however than in the cleaning cycle RG. The continuing concentricity monitoring during the secondary filling phase SF of the filling sequence $F_3$ ensures however that towards the end of the filling sequence $F_3$ the actual amount FM corresponds to the required amount FMS of washing liquid S. This illustrates that with the inventive dishwasher 1, faults during the primary filling phase PF can be compensated for, regardless of their extent, by subsequent filling in the following secondary phase.

Considered in summary it can thus be especially expedient to fill the dishwasher chamber 7 of the dishwasher 1 under time control so that, in fault-free operation, a static rated level is reached which is sufficient for concentric running of the circulating pump 22. In the event of a fault occurring, for example that the pressure is too low in a building-side water installation WH, it is however possible that with correct time control the rated level will not be reached. Thus, following on from the time-controlled primary filling phase PF, a concentricity monitoring procedure RP is carried out. Should concentric running still not have been achieved, in a subsequent secondary phase there is further filling until such time as concentric running is achieved. In this way disruptive slurping noises during the filling of the dishwasher 1 can be minimized. In addition an inadequate washing result by having too small an amount of washing liquid S as a result of a fault can be avoided. Furthermore the invention can be implemented at low cost.

In particular the following cost-optimized, quality based filling method can be worthwhile:

There is provision, by a combination of the principles of time filling and concentricity filling, to achieve a cost-effective filling method which very largely minimizes the quality risks of time filling as well as the noise disadvantages of pure concentricity filling.

Time filling refers to filling a water-operated domestic appliance, especially a dishwasher, via a valve which, because of a quantity regulation, has a rated inlet volume flow (e.g. 2.5 l/min), as well as a certain tolerance range around said flow (e.g. +/−10%). This constant volume flow is achieved in practice only if a certain minimum pipe pressure obtains in the water mains of the household (e.g. at least 1 bar). If this lies below this certain level the dishwasher is filled with less water in a specific unit of time than expected and the household appliance does not have sufficient water for the pump to run concentrically.

The principle of concentricity filling monitors specific motor parameters of the circulating pump motor during a filling process. By interpretation of the fluctuations the signal of the motor parameter, information can be obtained as to whether the pump is already running concentrically. During filling the circulating pump is operating permanently and generates a slurping noise as a result the absence of concentric running. For as long as no concentric running is detected further liquid is added until the concentric running of the circulating pump is achieved.

The basic principle here is that the domestic appliance is now filled to a static rated level via time filling by which concentric running should have been reached. In the event of faults such as underpressure or other faults in the pipe network, concentric running is not yet able to be achieved. Thus a concentric running check procedure is always subsequently appended to this first time filling. Should concentric running still not have been achieved, in these cases the corresponding additional volume is added via a concentricity filling. In these ways the disruptive slurping of the concentricity filling which occurs in the majority of households can be avoided and on the other hand the problem of households with an under pressure situation can also be avoided.

The advantages of this advantageous filling procedure are as follows:

- cost-effective filling method (time filling->valve always necessary, only timer (clock) on software, but no additional mechanical elements such as switches, magnets, impellers, . . . )
- Quality control of the time filling problem for households where the mains pressure is too low
- No adverse noise effects produced by filling in households with regular mains pressure

LIST OF REFERENCE CHARACTERS

1 Dishwasher
2 Control device
3 Operating device
4 Output device
5 Dishwashing container
6 Door
7 Dishwashing chamber

8 Housing
9 Upper crockery basket
10 Lower crockery basket
11 Pull out rail
12 Pull out rail
13 Water inlet device
14 Connection piece
15 Connection hose
16 Connection piece fixed to housing
17 Supply means, supply line
18 Inlet valve
19 Fluid inlet
20 Base of dishwashing chamber
21 Collecting device, collecting dish
22 Circulating pump
23 Upper spray arm
24 Lower spray arm
25 Concentricity monitoring device
26 Dispensing device
27 Drainage device
28 Drain pump
29 Connecting line
30 Connection fixed to the housing
31 Drain hose
32 Connection piece
33 Signal line
34 Signal line
35 Control line
36 Control line
37 Signal line
38 Control line
WH Water supply device, water faucet
ZW inlet water
S Washing liquid
AR Waste water disposal device, drainage pipe
AW Waste water
F Filling sequence
ST Start
PF Primary filling phase
RP Concentricity checking
SF Secondary filling phase
EN End
SG Wash cycle
VG Prewash cycle
RG Cleaning cycle
KG Final rinse cycle
TG Drying cycle
DT Default time
Z18 Operating state of the inlet valve
FM Actual amount of washing liquid with which the dishwashing chamber is filled
FMS Nominal amount of washing liquid with which the dishwashing chamber is to be filled
N22 Speed of the circulating pump
NN Rated speed of the circulating pump
P22 Power consumption of the circulating pump
PN Rated power consumption of the circulating pump
Z28 Operating state of the drain pump

The invention claimed is:

1. A dishwasher, comprising:

a control device programmed to control a dishwashing cycle for cleaning items to be washed, a dishwashing chamber for accommodating the items to be washed during the dishwashing cycle, an inlet valve switchable by the control device for filling the dishwashing chamber with washing liquid, a circulating pump configured for adjustment by the control device and for circulating the washing liquid located in the dishwashing chamber, wherein the dishwashing cycle comprises at least one filling sequence in which the control device is programmed to open the inlet valve during a primary filling phase having a duration set to a default time, with the default time corresponding to a nominal amount of washing liquid to be filled into the dishwashing chamber and sufficient for a concentric running of the circulating pump running at a rated speed, and a concentricity monitoring unit, wherein the control device is programmed to control the concentricity monitoring unit to perform at an end of the primary filling phase a concentricity check to ascertain whether the circulating pump is running concentrically at the rated speed, wherein the control device is programmed to terminate the filling sequence at the default time when the circulating pump is running concentrically and to continue the filling sequence when the circulating pump is not running concentrically.

2. The dishwasher of claim 1, wherein the control device is programmed to block the inlet valve following the end of the primary filling phase when the concentricity monitoring unit has established that the circulating pump is running concentrically.

3. The dishwasher of claim 1, wherein the control device is programmed to continue the filling sequence by performing a secondary filling phase with the inlet valve open and the circulating pump running at the rated speed, with the secondary filling phase being terminated by the control device when the circulating pump begins to run concentrically.

4. The dishwasher of claim 3, wherein the control device is programmed to perform the secondary filling phase immediately following the primary filling phase.

5. The dishwasher of claim 3, wherein the control device is programmed to control the inlet valve such that the inlet valve remains open from a start of the primary filling phase until termination of the secondary filling phase.

6. The dishwasher of claim 1, wherein the dishwashing cycle comprises at least one water-conducting partial wash cycle, and the at least one filling sequence is performed at a start of the at least one water-conducting partial wash cycle.

7. The dishwasher of claim 1, wherein an inlet side of the inlet valve is configured for connection to an external water supply.

8. The dishwasher of claim 1, wherein the circulating pump comprises an electric motor and wherein the control device is programmed to control the concentricity monitoring unit to monitor fluctuations of at least one electrical operating parameter of the electric motor.

9. The dishwasher of claim 1, wherein the concentricity monitoring unit is a component of the control device.

10. The dishwasher of claim 1, wherein the dishwasher is a domestic dishwasher.

11. A method for carrying out a dishwashing cycle for cleaning items to be washed in a dishwashing chamber of a dishwasher, the dishwasher comprising:

a control device programmed to control the dishwashing cycle for cleaning the items to be washed, the dishwashing chamber for accommodating the items to be washed during the dishwashing cycle, an inlet valve switchable by the control device for filling the dishwashing chamber with washing liquid, a circulating pump configured for adjustment by the control device and for circulating the washing liquid located in the dishwashing chamber, wherein the dishwashing cycle comprises at least one filling sequence in which the control device is programmed to open the inlet valve during a primary filling phase having a duration set to a default time, with the default time corresponding to a nominal amount of washing liquid to be filled into the dishwashing chamber and sufficient for a concentric running of the circulating pump running at a rated speed, and a concentricity monitoring unit, wherein the control device is programmed to control the concentricity monitoring unit to perform at an end of the primary filling phase a concentricity check to ascertain whether the circulating pump is running concentrically at the rated speed, wherein the control device is programmed to terminate the filling sequence at the default time when the circulating pump is running concentrically and to continue the filling sequence when the circulating pump is not running concentrically, the method comprising the steps of:

performing at least one filling sequence of the dishwashing chamber by opening the inlet valve during the primary filling phase for the duration which depends on the default time, the default time corresponding to the nominal amount of washing liquid to be filled into the dishwashing chamber and sufficient for the concentric running of the circulating pump running at the rated speed, and performing at the end of the primary filling phase the concentricity check to ascertain whether the circulating pump is running concentrically at the rated speed, wherein the filling sequence is terminated when the circulating pump is running concentrically at the default time and the filling sequence is continued when the circulating pump is not running concentrically.

12. The dishwasher of claim 1, wherein the circulating pump comprises an electric motor, and wherein the control device is programmed to control the concentricity monitoring unit to perform the concentricity check by determining an actual consumed power of the circulating pump at the end of the primary filling phase and comparing the actual consumed power to a rated power consumption of the circulating pump corresponding to the default time.

* * * * *